US010052637B2

(12) United States Patent
Mankosa et al.

(10) Patent No.: US 10,052,637 B2
(45) Date of Patent: Aug. 21, 2018

(54) MATERIAL PROCESSING SYSTEM

(71) Applicant: Eriez Manufacturing Co., Erie, PA (US)

(72) Inventors: Michael J. Mankosa, Erie, PA (US); Jaisen N. Kohmuench, Erie, PA (US); Eric S. Yan, Erie, PA (US); Reginaldo Sérgio Liberato, Nova Lima-Minas Gerais (BR)

(73) Assignee: Eriez Manufacturing Co., Erie, PA (US)

( * ) Notice: Subject to any disclaimer, the term of this patent is extended or adjusted under 35 U.S.C. 154(b) by 477 days.

(21) Appl. No.: 14/146,474

(22) Filed: Jan. 2, 2014

(65) Prior Publication Data

US 2015/0182973 A1 Jul. 2, 2015

(51) Int. Cl.

| | |
|---|---|
| ***B03D 1/14*** | (2006.01) |
| ***B03D 1/24*** | (2006.01) |
| ***B03B 9/00*** | (2006.01) |
| ***B03B 5/28*** | (2006.01) |
| ***B03B 5/66*** | (2006.01) |
| ***C22B 1/00*** | (2006.01) |
| ***B03D 1/02*** | (2006.01) |
| ***B03D 1/08*** | (2006.01) |

(52) U.S. Cl.

CPC ..... *B03B 5/28* (2013.01); *B03B 5/66* (2013.01); *B03B 9/00* (2013.01); *B03D 1/02* (2013.01); *B03D 1/025* (2013.01); *B03D 1/085* (2013.01); *B03D 1/14* (2013.01); *B03D 1/24* (2013.01); *C22B 1/00* (2013.01)

(58) Field of Classification Search

None

See application file for complete search history.

(56) References Cited

U.S. PATENT DOCUMENTS 3,782,539 A * 1/1974 Painter ..... B03D 1/021 209/166
4,227,996 A * 10/1980 Levine ..... B03D 1/01 209/166
5,795,484 A * 8/1998 Greenwald, Sr. .. B01D 33/0315 209/10

* cited by examiner

*Primary Examiner* — Thomas M Lithgow
(74) *Attorney, Agent, or Firm* — Jonathan M. D'Silva; MMI Intellectual Property

(57) ABSTRACT

What is presented is a material processing system for processing tailings discharged from an ore processing system. The tailings comprise coarse waste rock, the fine waste rock, coarse valuable product, and the fine valuable product. The material processing system comprises a classification element, a coarse flotation element, and a fines flotation element arranged to separate the coarse valuable product, the coarse waste rock, the fine valuable product, and the fine waste rock. The classification element separates the coarse waste rock and/or the coarse valuable product from the fine waste rock and/or the fine valuable product. The coarse flotation element separates the coarse waste rock from the coarse valuable product, the fine waste rock, and/or the fine valuable product. The fines flotation element separates the fine valuable product from the coarse waste rock, the fine waste rock, and/or the coarse valuable product.

24 Claims, 12 Drawing Sheets

MATERIAL PROCESSING SYSTEM

BACKGROUND

Ore processing systems are used all over the world in the mining industry. These processing systems take ore and rock from mines and crush it to recover target valuable product that is taken to market and sold for profit. These ore processing systems typically recover 85-90% of the valuable product, meaning they do not recover 10-15% of the valuable product which remains in the waste tailings from the ore processing system. Unrecoverable loss occurs either because of the mass, shape, or other factors associated with the valuable product or the valuable product is unintentionally discharged from the system through the stream of waste rock. Losing valuable product of this magnitude equates to lost profit for the ore processing system. Material recovery systems that attempt to recover and collect this lost valuable product have been used in the industry in the past, however, these prior art material processing systems are inefficient, ineffective, and unreliable. Thus, there is a need in the industry to improve recovery and collection of the lost valuable product in material processing systems. What is presented is an improved material processing system and methodology that processes tailings from ore processing systems to recover the valuable product unintentionally discharged from an ore processing system.

SUMMARY

What is presented is a material processing system and method for processing tailings discharged from an ore processing system. The tailings comprise coarse waste rock, the fine waste rock, coarse valuable product, and the fine valuable product. The material processing system comprises a classification element, a coarse flotation element, and a fines flotation element arranged to separate the coarse valuable product, the coarse waste rock, the fine valuable product, and the fine waste rock. The classification element separates the coarse waste rock and/or the coarse valuable product from the fine waste rock and/or the fine valuable product. The coarse flotation element separates the coarse waste rock from the coarse valuable product, the fine waste rock, and/or the fine valuable product. The fines flotation element separates the fine valuable product from the coarse waste rock, the fine waste rock, and/or the coarse valuable product.

In some embodiments, the tailings are sent to the classification element, to separate the coarse waste rock and the coarse valuable product from the fine waste rock and the fine valuable product. The coarse waste rock and the coarse valuable product from the classification element are then sent to the coarse flotation element to separate the coarse valuable product from the coarse waste rock. The fine waste rock and the fine valuable product from the classification element are then sent to the fines flotation element to separate the fine valuable product from the fine waste rock.

In some embodiments, the tailings are sent to the coarse flotation element, to separate the coarse waste rock from the coarse valuable product, the fine waste rock, and the fine valuable product. The coarse valuable product, the fine waste rock, and the fine valuable product are sent to the classification element to separate the coarse valuable product from the fine waste rock and the fine valuable product. The fine waste rock and the fine valuable product from the classification element are sent to the fines flotation element to separate the fine valuable product from the fine waste rock.

In some embodiments, the tailings are sent to the coarse flotation element, to separate the coarse waste rock from the coarse valuable product, the fine waste rock, and the fine valuable product. The coarse valuable product, the fine waste rock, and the fine valuable product are sent to the fines flotation element to separate the fine valuable product from the fine waste rock and the coarse valuable product. The fine waste rock and the coarse valuable product from the fines flotation element are sent to the classification element to separate the coarse valuable product from the fine waste rock.

In some embodiments, the tailings are sent to the fines flotation element, to separate the fine valuable product from the coarse valuable product, the coarse waste rock, and the fine waste rock. The coarse valuable product, the coarse waste rock, and the fine waste rock are sent to the coarse flotation element to separate the coarse waste rock from the fine waste rock and the coarse valuable product. The fine waste rock and the coarse valuable product from the coarse flotation element are sent to the classification element, to separate the coarse valuable product from the fine waste rock.

In some embodiments, the tailings are sent to the fines flotation element to separate the fine valuable product from the coarse valuable product, the coarse waste rock, and the fine waste rock. The coarse valuable product, the coarse waste rock, and the fine waste rock are sent to the classification element to separate the fine waste rock from the coarse valuable product and the coarse waste rock. The coarse valuable product and the coarse waste rock from the classification element are sent to the coarse flotation element to separate the coarse valuable product from the coarse waste rock.

In some embodiments, the material processing system further comprises a second classification element for further classifying the coarse valuable product. In some of these embodiments, the tailings are sent to the classification element, to separate the coarse waste rock and the coarse valuable product from the fine waste rock and the fine valuable product. The coarse waste rock and the coarse valuable product from the classification element are sent to the coarse flotation element, to separate the coarse valuable product from the coarse waste rock. The coarse valuable product from the coarse flotation element is sent to the second classification element, to further classify the coarse valuable product to remove any of the fine waste rock and the fine valuable product that may have bypassed the coarse flotation element in the coarse valuable product. The fine waste rock and the fine valuable product from the classification element are sent to the fines flotation element to separate the fine valuable product from the fine waste rock.

In other embodiments that comprise a second classification element, the tailings are sent to the classification element to separate the coarse waste rock and the coarse valuable product from the fine waste rock and the fine valuable product. The coarse valuable product and coarse waste rock from the classification element is sent to the second classification element to further classify the coarse valuable product and coarse waste rock to remove any of the fine waste rock and the fine valuable product that may have been wrongly separated by the classification element in the coarse valuable product and coarse waste rock. The fine waste rock and the fine valuable product from the classification element are sent to the fines flotation element, to separate the fine valuable product from the fine waste rock.

In other embodiments that comprise a second classification element, the tailings are sent to the classification element, to separate the coarse waste rock and the coarse valuable product from the fine waste rock and the fine valuable product. The coarse valuable product and the coarse waste rock from the classification element are sent to the second classification element, to further classify the coarse valuable product and coarse waste rock, to remove any of the fine waste rock and the fine valuable product that may have been wrongly separated by the classification element in the coarse valuable product and coarse waste rock. The fine valuable product and the fine waste rock from the second classification element are reintroduced into the fine waste rock and the fine valuable product from the classification element. The fine waste rock and the fine valuable product from the classification element are sent to the fines flotation element, to separate the fine valuable product from the fine waste rock.

The coarse valuable product and the fine valuable product could be copper, gold, or phosphorous. Both the coarse valuable product and the fine valuable product could be rendered hydrophobic. The classification element could sort the tailings by mass and the classification element could be one of a cyclone separator, hindered-bed density separator, or screen. The coarse flotation element could be an air-assisted hindered-bed density separator and the fines flotation element could be a column separator.

The material processing system could comprise a re-grind mill and/or a flotation machine, either or both positioned to process coarse valuable product and/or the fine valuable product from the classification element, coarse flotation element, and fines flotation element.

Those skilled in the art will realize that this invention is capable of embodiments that are different from those shown and that details of the devices and methods can be changed in various manners without departing from the scope of this invention. Accordingly, the drawings and descriptions are to be regarded as including such equivalent embodiments as do not depart from the spirit and scope of this invention.

BRIEF DESCRIPTION OF DRAWINGS

For a more complete understanding and appreciation of this invention, and its many advantages, reference will be made to the following detailed description taken in conjunction with the accompanying drawings.

DETAILED DESCRIPTION

Figure 1A:
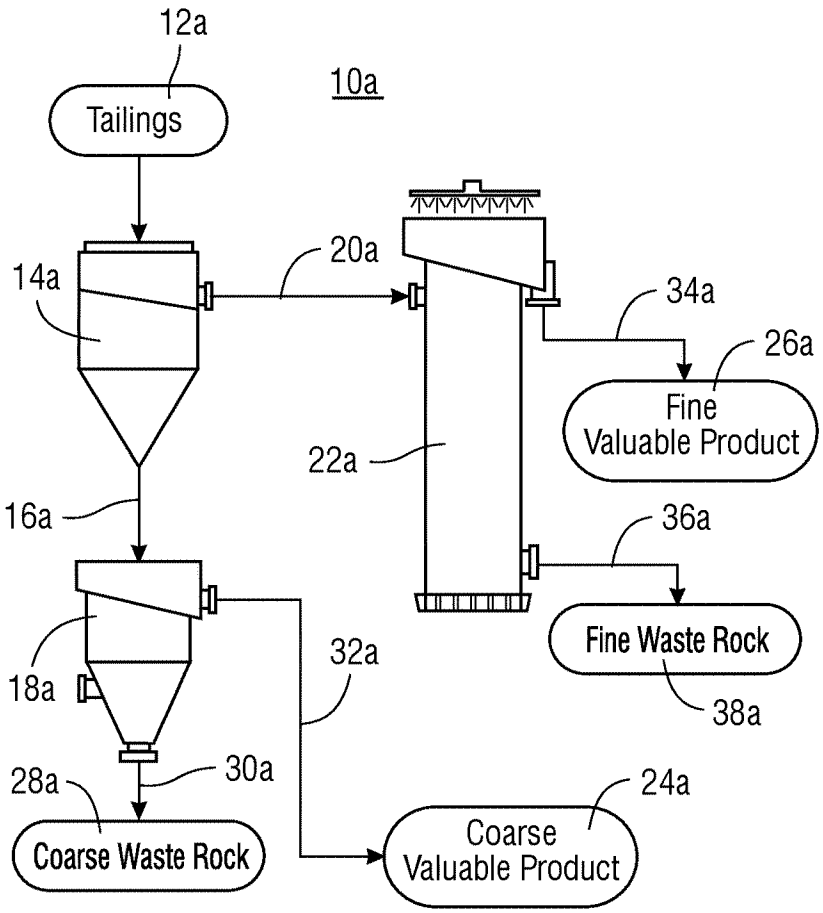
FIG. 1A shows a schematic view of an embodiment of the material processing system of FIG. 1.

Referring to the drawings, some of the reference numerals are used to designate the same or corresponding parts through several of the embodiments and figures shown and described. Corresponding parts are denoted in different embodiments with the addition of lowercase letters. Variations of corresponding parts in form or function that are depicted in the figures are described. It will be understood that variations in the embodiments can generally be interchanged without deviating from the invention.

Tailings from ore processing systems are often discharged as slurry mixtures comprising water, coarse waste rock, fine waste rock, coarse valuable product, and fine valuable product. Some limited processing of the tailings has been conducted in the prior art, but that processing has tended to not be very efficient or effective and is typically unprofitable. What is presented is a material processing system that comprises a combination of three elements in a variety of configurations: a classification element, a coarse flotation element, and a fines flotation element.

The classification element, the coarse flotation element, and the fines flotation element are arranged in a variety of ways to separate from the tailings the coarse waste rock, the fine waste rock, the coarse valuable product, and the fine valuable product to maximize recovery of the coarse valuable product and the fine valuable product. The use of these three elements in combination has been found to be much more effective than prior art tailings processing systems.

The classification element essentially separates the tailings by mass or density, or more specifically, the classification element separates coarse waste rock and/or coarse valuable product from fine waste rock and/or fine valuable product. The classification element is typically embodied as a hindered-bed density separator, a cyclone separator, or a screen, but may be embodied as other devices capable of separating the coarse waste rock and/or the coarse valuable product from the fine waste rock and/or the fine valuable product. Each of these embodiments are known to those having ordinary skill in the art and any descriptions of their function presented herein are not meant to be exhaustive or comprehensive but are only presented for purposes of clarification and narration.

The preferred classification element is a hindered-bed density separator, for example a CROSSFLOAT separator manufactured by Eriez Manufacturing of Erie, Pa. Hindered-bed density separators utilize a fluidized bed created from the upward flow of teeter water interacting with a downward flow of a particulate slurry to separate coarse waste rock and/or coarse valuable product from fine waste rock and/or fine valuable product. Those having skill in the art also know fluidized beds as hindered-beds. Coarse waste rock and coarse valuable product heavy enough to penetrate the fluidized bed, fall down through the fluidized bed to be discharged through a course output at the bottom of the separator. The fine waste rock and fine valuable product that cannot penetrate the fluidized bed are kept floating above the fluidized bed until the upward flow of teeter water ultimately pushes them over the top of the separator to be discharged through a fines output.

Cyclone separators separate coarse waste rock and/or coarse valuable product from fine waste rock and/or fine valuable product through vortex separation. To create the vortex, a high speed rotating fluid flow is established within the cyclone separator. The fluid flows in a helical pattern starting from the bottom of the cyclone separator and flowing upwards to its top. Coarse waste rock and/or coarse valuable product entering the cyclone separator will have too much inertia to follow the rotating fluid flow upwards. The coarse waste rock and/or the coarse valuable product instead strike against inner walls of the cyclone separator and fall out of the bottom through a coarse output. Since fine waste rock and/or fine valuable product have much less mass, they follow the fluid flow up and out of the top of the cyclone separator through a fine output.

Screens comprise an angled or graduated woven screen element, such as a mesh or a net, to separate coarse valuable product and/or coarse waste rock from fine valuable product and/or fine waste rock. The components to be separated enter the screen at the highest point of the woven screen element and then descend towards the lowest point of the woven screen element by rolling, sliding, and/or tumbling. While rolling, sliding, and/or tumbling, the components to be separated are broken up by grinding against other components or against the woven screen element. Fine valuable product and/or fine waste rock fall through holes in the woven screen element and discharge from the screen through the fines output. Coarse valuable product and/or coarse waste rock will roll, slide, and/or tumble on top of the woven screen element without falling through because they are too large to fit through the holes and discharge out of the screen through the coarse output. The woven screen element may also have the ability to vibrate, which assists the components to be separated by rolling, sliding, and/or tumbling. It should be understood that those having ordinary skill in the art will also know the screen as a sieve or sifter.

The coarse flotation element separates coarse valuable product from coarse waste rock, fine waste rock, and/or fine valuable product. The coarse flotation element is preferably an air-assisted hindered-bed density separator; for example, the HYDROFLOAT separator manufactured by Eriez Manufacturing of Erie, Pa., but may be embodied as other devices capable of separating the coarse valuable product from the coarse waste rock, the fine waste rock, and/or the fine valuable product. The air-assisted hindered-bed density separator is similar to the hindered-bed density separator in that this separator creates a fluidized bed by flowing teeter water upwards against a downward flow of particulate slurry. However, in this case teeter water also includes gas bubbles in the flow. The gas bubbles selectively adhere to target fine valuable product and coarse valuable product to alter their density and encourage them to float to the top of the separator and be ultimately removed from the separator through a fine valuable product output. The chemistry of the target valuable product may be modified to make them more likely to attach to a gas bubble for removal. Coarse waste rock heavy enough to penetrate the fluidized bed falls down through the fluidized bed to be discharged through a course waste output at the bottom of the separator. In addition to coarse valuable product with sufficient bubbles, the fine waste rock and fine valuable product that cannot penetrate the fluidized bed are kept floating above the fluidized bed until the upward flow of teeter water ultimately pushes them over the top of the separator to be discharged through the fine valuable product output. The air assisted hindered-bed density separator is known to those having ordinary skill in the art and any description of its function presented herein is not meant to be exhaustive or comprehensive but is only presented for purposes of clarification and narration.

The fines flotation element separates fine valuable product from coarse waste rock, fine waste rock, and/or coarse valuable product. The fines flotation element is typically embodied as a column separator, but may be embodied as other devices capable of separating the fine valuable product from the coarse waste rock, the fine waste rock, and/or the coarse valuable product. Column separators are flotation devices that also act as three phase settlers where particles move downwards in a hindered settling environment countercurrent to a swarm of rising air bubbles that are generated by spargers located at the bottom of the column separator. The column separators are effective in capturing fine valuable product that adheres to the air bubbles to be carried over the top of the separator and subsequently discharged from a fine product output while the coarse product, coarse waste rock, and/or fine waste rock are discharged from the bottom of the separator through a coarse product/waste output. Column separators are known to those having ordinary skill in the art and any description of their function presented herein is not meant to be exhaustive or comprehensive but is only presented for purposes of clarification and narration.

It should be understood that the target coarse valuable product and the fine valuable product may both be in gold, copper, phosphates, or other target valuable product. It should also be understood that reagents may be introduced within the tailings, the classification element, the coarse flotation element, and/or fines flotation element to render the coarse valuable product and/or the fine valuable product more hydrophobic and to facilitate separation of the coarse valuable and/or fine valuable product from the coarse waste rock and/or the fine waste rock.

Figure 1:
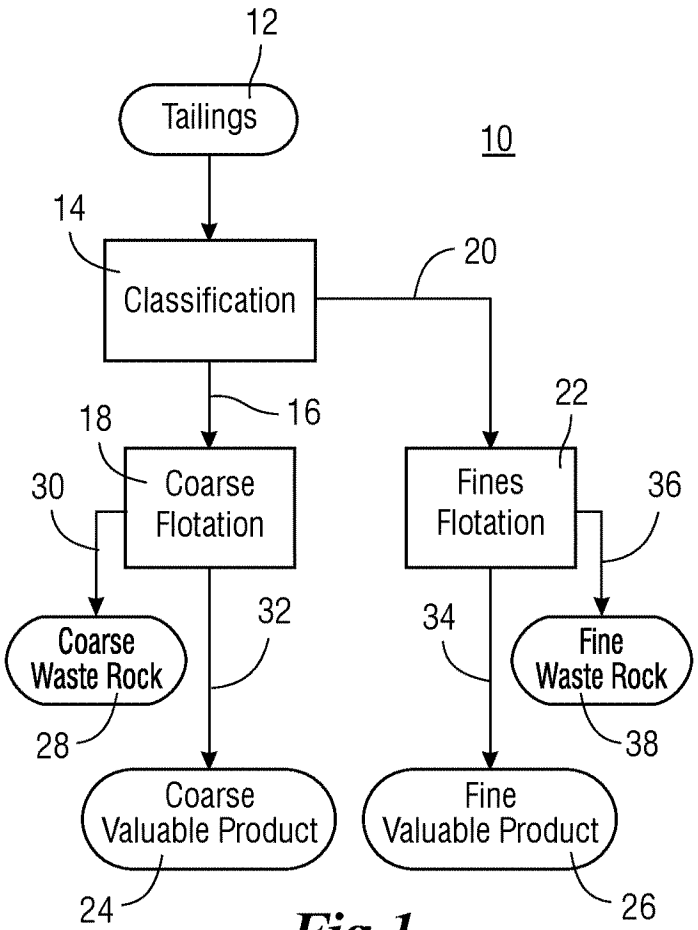
FIG. 1 shows a flow-chart of the material processing system.

The preferred effective arrangement of the material processing system 10 is shown in FIG. 1. In this embodiment, the tailings 12 are first sent to the classification element 14 to separate the coarse waste rock and the coarse valuable product from the fine waste rock and the fine valuable product. The classification element 14 discharges the coarse waste rock and the coarse valuable product through its coarse output 16 to the coarse flotation element 18. The coarse flotation element 18 separates and extracts the coarse valuable product from the coarse waste rock. The coarse valuable product is removed through a coarse/valuable product output 32 from the material processing system 10 to a coarse valuable product collection area 24 for removal or further processing as necessary. The coarse waste rock is discharged through the coarse waste output 30 to a coarse waste rock collection area 28. The classification element 14 discharges the fine waste rock and the fine valuable product through its fines output 20 to the fines flotation element 22. The fines flotation element 22 then separates and extracts the fine valuable product from the fine waste rock. The fine valuable product is removed through a fine valuable product output 34 from the material processing system 10 to a fine valuable product collection area 26 for removal or further processing as necessary. The fine waste rock is discharged through a fine waste output 36 to a fine waste rock collection area 38. In some instances the coarse valuable product collection area 24 and the fine valuable product collection area 26 may be the same area. The coarse waste rock within the coarse waste rock collection area 28 and the fine waste rock collection area 38 from the coarse flotation element 18 and the fines flotation element 22 are generally discarded.

It should be understood that due to variations in the tailings material and/or the process, the coarse valuable product and/or the fine valuable product in the coarse valuable product collection area 24 and the fine valuable product collection area 26 may include coarse waste rock and/or fine waste rock. Recovered coarse valuable product and/or fine valuable product in the coarse valuable product collection area 24 and the fine valuable product collection area 26 may sometimes require further processing to liberate the valuable product from the waste rock. In such instances, the coarse valuable product and/or the fine valuable product in the coarse valuable product collection area 24 and/or the fine valuable product collection area 26 are sent to a re-grind mill to liberate waste rock from the coarse valuable product and/or the fine valuable product. In some instances, this reground material can be circulated back to the material processing system 10 for reprocessing. A flotation machine may be incorporated to attempt to separate the newly liberated valuable product from the waste rock prior to returning the reground material to the material processing system 10.

FIG. 1A shows an embodiment of the material processing system 10*a* that implements the arrangement disclosed in FIG. 1. In this embodiment, the classification element 14*a* is a hindered-bed density separator as described above. Coarse waste rock and coarse valuable product are discharged through the course output 16*a* at the bottom of the classification element 14*a*. The fine waste rock and the fine valuable product are ultimately discharged through the fines output 20*a* of the classification element 14*a*.

After being discharged from the coarse output 16*a*, the coarse valuable product and the coarse waste rock are conveyed to the coarse flotation element 18*a*. The coarse flotation element 18*a* in this embodiment is as an air-assisted, hindered-bed density separator. The coarse flotation element 18*a* separates the coarse waste rock from the coarse valuable product. The coarse waste rock is discharged to a coarse waste rock collection area 28*a* through the coarse waste output 30*a* and the coarse valuable product is discharged to the coarse valuable product collection area 24*a* through a coarse/valuable product output 32*a*.

The fine valuable product and the fine waste rock from the fines output 20*a* are conveyed to the fines flotation element 22*a* for separation. The fines flotation element 22*a* is embodied as a column separator. The fine valuable product is discharged through the fine valuable product output 34*a* to the fine valuable product collection area 26*a* for further processing. The fine waste rock is discharged through a fine waste output 36*a* to a fine waste rock collection area 38*a*.

Figure 1C:
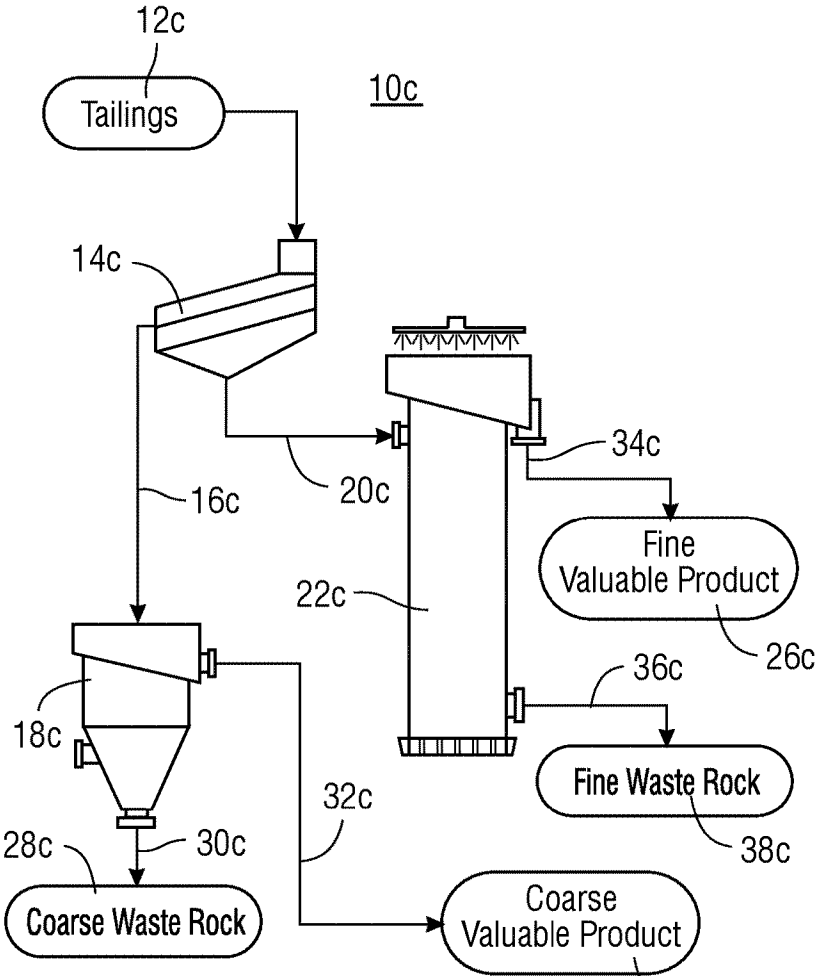
FIG. 1C shows a schematic view of another embodiment of the material processing system of FIG. 1.
Figure 1B:
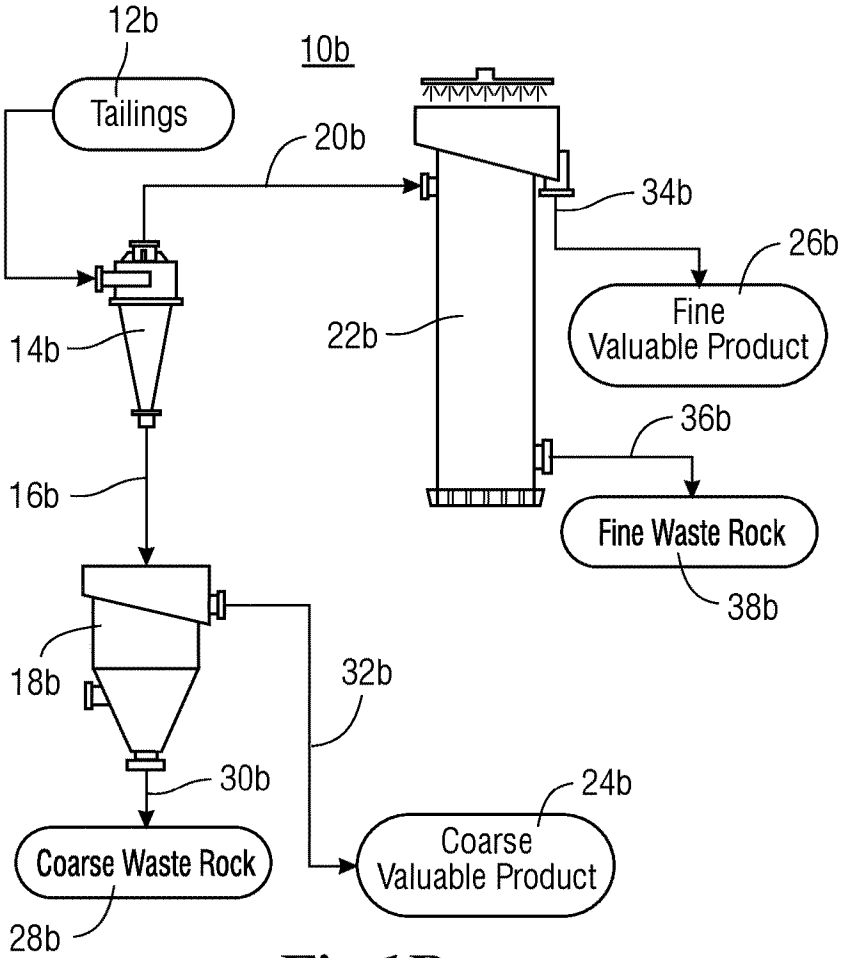
FIG. 1B shows a schematic view of another embodiment of the material processing system of FIG. 1.

FIG. 1B shows another embodiment of the material processing system 10*b* that implements the arrangements disclosed in FIG. 1, as discussed above. In this embodiment, the coarse flotation element 18*b* is an air-assisted hindered-bed density separator and functions in the same way as discussed above. The fines flotation element 22*b* is a column separator and also functions in the same way as discussed above. However, in this embodiment, the classification element 14*b* is a cyclone separator which functions as described above.

FIG. 1C shows another embodiment of the material processing system 10*c* that implements the arrangements disclosed in FIG. 1, as discussed above. In this embodiment, the coarse flotation element 18*c* is an air-assisted hindered-bed density separator and functions in the same way as discussed above. The fines flotation element 22*c* is embodied as a column separator and also functions in the same way as discussed above. However, in this embodiment, the classification element 14*c* is a screen which functions as described above.

Figure 1E:
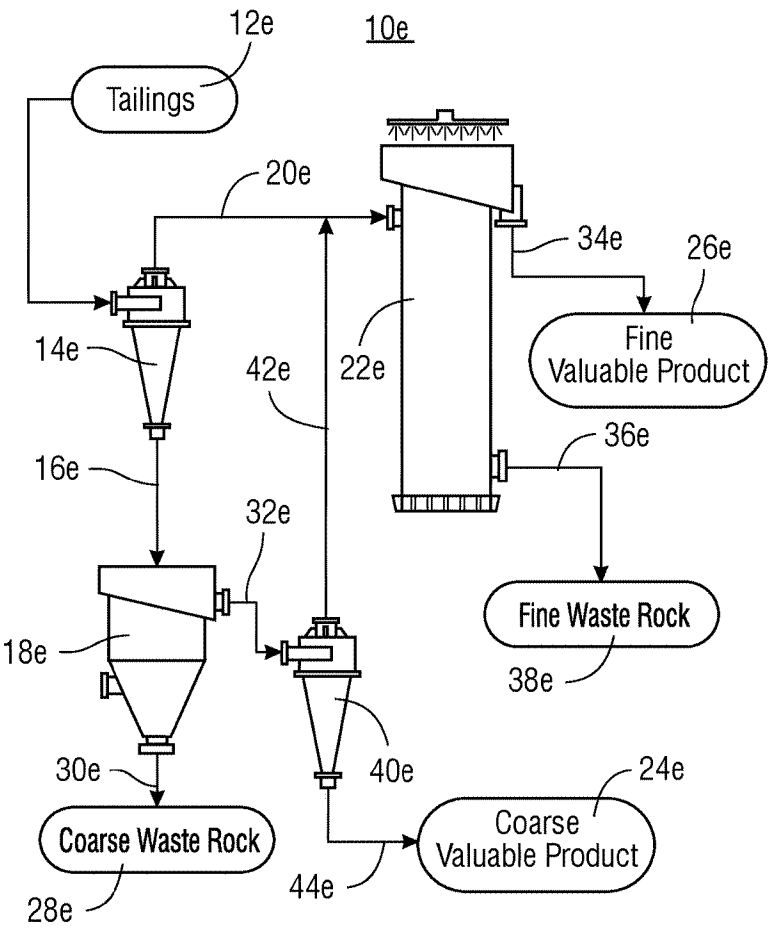
FIG. 1E shows a schematic view of another embodiment of the material processing system of FIG. 1.
Figure 1D:
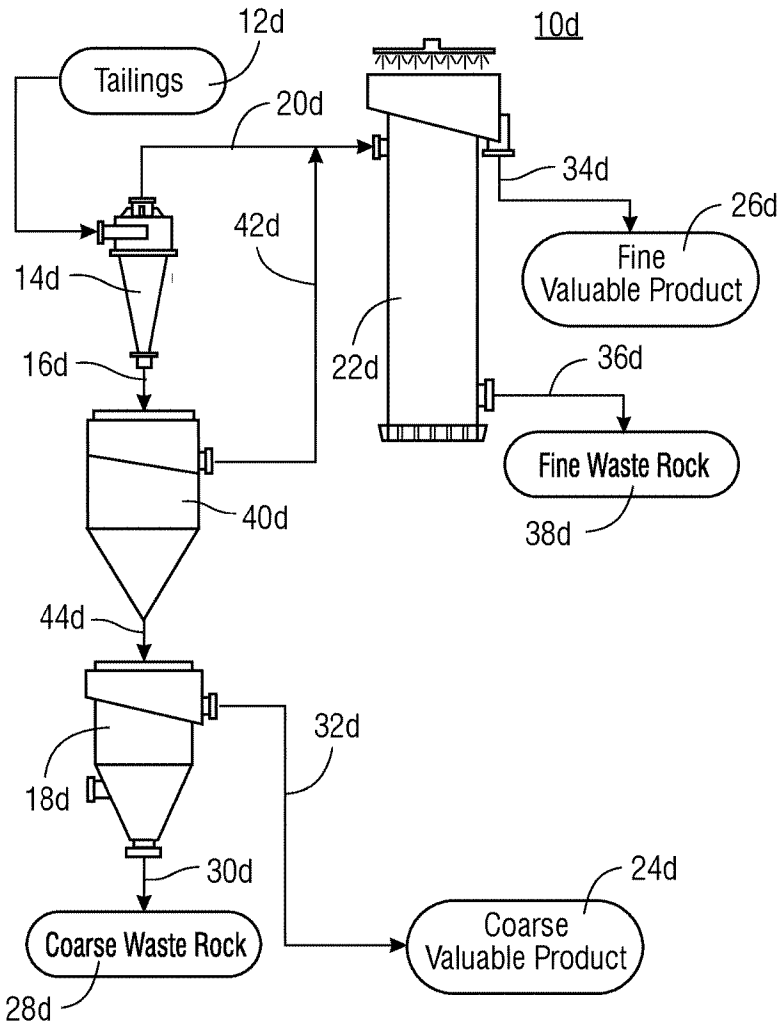
FIG. 1D shows a schematic view of another embodiment of the material processing system of FIG. 1.

FIG. 1D shows another embodiment of the material processing system 10*d* that implements the arrangements disclosed in FIG. 1, as discussed above, but also comprises a second classification element 40*d*. In this embodiment the classification element is a cyclone separator that functions as discussed above. Coarse waste rock and coarse valuable product discharged through the course output 16*d* of the classification element 14*d* is sent to the second classification element 40*d* to remove any fine waste rock and fine valuable product that may have bypassed the classification element 14*d* due to inefficiencies in the cyclone separator. The second classification element 40*d* is a hindered-bed density separator that functions as discussed above.

Once separation in the second classification element 40*d* is complete, any fine coarse product and fine waste rock recovered is discharged through a second fine output 42*d* and reintroduced to the fines output 20*d* of the classification element 14*d* to be conveyed to the fines flotation element 22*d*. In this embodiment of the material processing system 10*d*, the fines flotation element 22*d* is a column separator that functions in the same way as discussed above.

The coarse valuable product and the coarse waste rock fall downwardly through the second classification element 40*d* and are discharged out a second coarse output 44*d* to be conveyed to the coarse flotation element 18*d*, which will separate the coarse valuable product from the coarse waste rock. The coarse flotation element 18*d* in this embodiment is an air-assisted hindered-bed density separator that functions in the same way as discussed above.

FIG. 1E shows another embodiment of the material processing system 10*e* that implements the arrangements disclosed in FIG. 1, as discussed above, but also comprises a second classification element 40*e* in a different arrangement from that shown in FIG. 1D. In this embodiment, both the classification element 14*e* and the second classification element 40*e* are cyclone separators that function as described above. However, in this embodiment, the second classification element 40*e* is located downstream of the coarse flotation element 18*e*. The coarse valuable product from the coarse/valuable product output 32*e* of the coarse flotation element 18*e* is conveyed to the second classification element 40*e* for reprocessing to separate any fine waste rock or fine valuable product that may have bypassed the classification element 14*e* due to inefficiencies in the cyclone separator.

Once separation in the second classification element 40*e* is complete, any fine coarse product and fine waste rock recovered is discharged through a second fine output 42*e* and reintroduced to the fines output 20*e* of the classification element 14*e* to be conveyed to the fines flotation element 22*e*. In this embodiment of the material processing system 10*e*, the fines flotation element 22*e* is a column separator that functions in the same way as discussed above.

The coarse valuable product falls downwardly through the second classification element 40*e* and is discharged out a second coarse output 44*e* to be conveyed to the coarse valuable product collection area 24*e*.

Figure 1F:
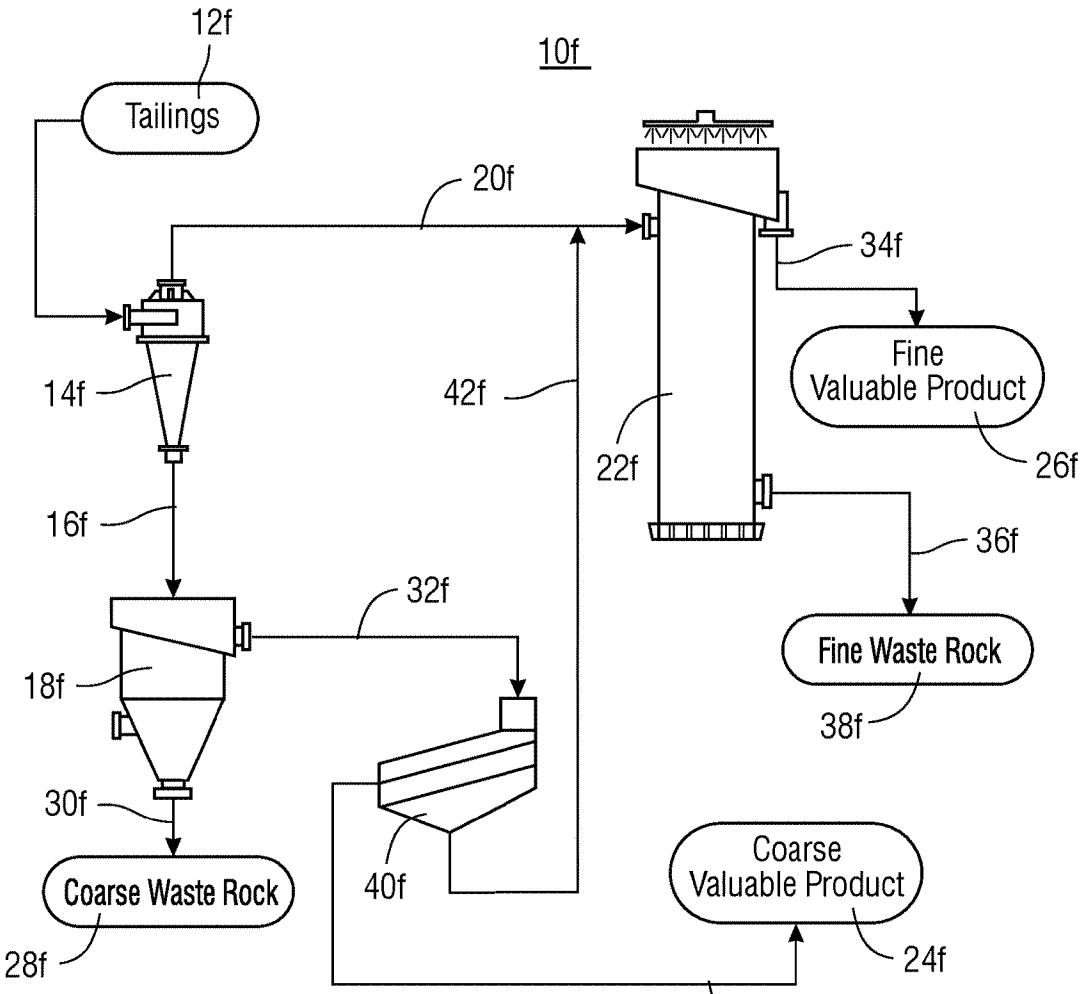
FIG. 1F shows a schematic view of another embodiment of the material processing system of FIG. 1.

FIG. 1F shows another embodiment of the material processing system 10*f* that implements the arrangements disclosed in FIG. 1 but also comprises a second classification element 40*f* arranged in the same way as the embodiment of the material processing system disclosed in FIG. 1E above. In this embodiment, however, the second classification element 40*f* is a screen that functions in the same way as discussed above.

Figure 2A:
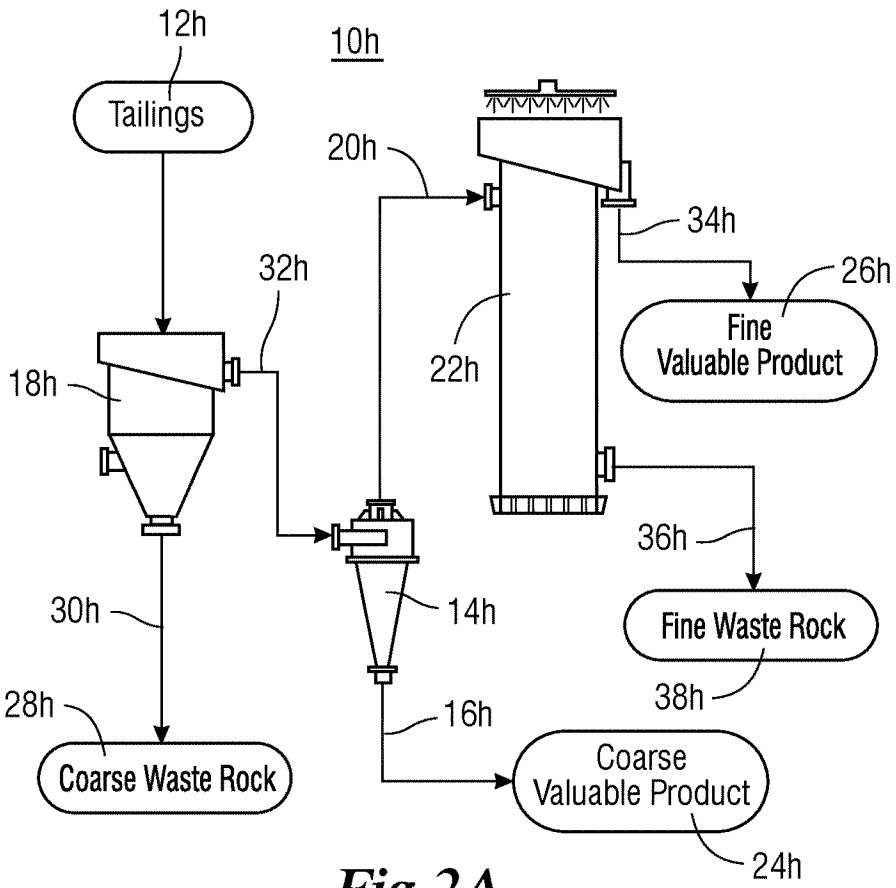
FIG. 2A shows a schematic view of an embodiment of the material processing system of FIG. 2.
Figure 2:
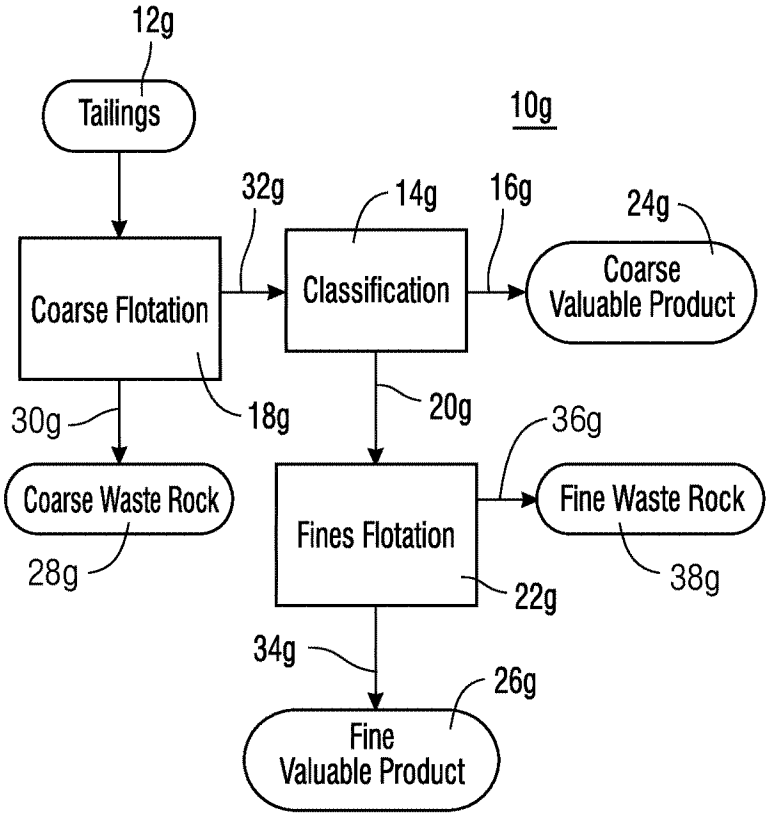
FIG. 2 shows a flow-chart of another configuration of the material processing system.

Another effective arrangement of the material processing system 10*g* is shown in FIG. 2. In this embodiment, the tailings 12*g* are first sent to a coarse flotation element 18*g* to separate and extract the coarse waste rock from the coarse valuable product, the fine waste rock, and the fine valuable product. The coarse waste rock is discharged through the coarse waste output 30*g* to a coarse waste rock collection area 28*g*. The coarse flotation element 18*g* discharges the coarse valuable product, the fine valuable product, and the fine waste rock through the coarse/valuable product output 32*g* to be conveyed to the classification element 14*g*. The classification element 14*g* then separates the coarse valuable product from the fine valuable product and the fine waste rock. The coarse valuable product is discharged from the course output 16*g* to the coarse valuable product collection area 24*g*. The fine waste rock and the fine valuable product are discharged from the classification element 14*g* through the fines output 20*g* and conveyed to the fines flotation element 22*g*. The fines flotation element 22*g* then separates and extracts the fine valuable product from the fine waste rock and the fine valuable product is discharged from the fine valuable product output 34*g* to a fine valuable product collection area 26*g* for further processing. The fine waste rock is discharged through the fine waste output 36*g* to a fine waste rock collection area 38*g*.

FIG. 2A shows an embodiment of the material processing system 10*h* that implements the arrangement disclosed in FIG. 2 as discussed above. In this embodiment, the coarse flotation element 18*h* is an air-assisted hindered-bed density separator that functions in the same way as discussed above; the classification element 14*h* is a cyclone separator that functions in the same way as discussed above; and the fines flotation element 22*h* is a column separator that also functions in the same way as discussed above.

Figure 2C:
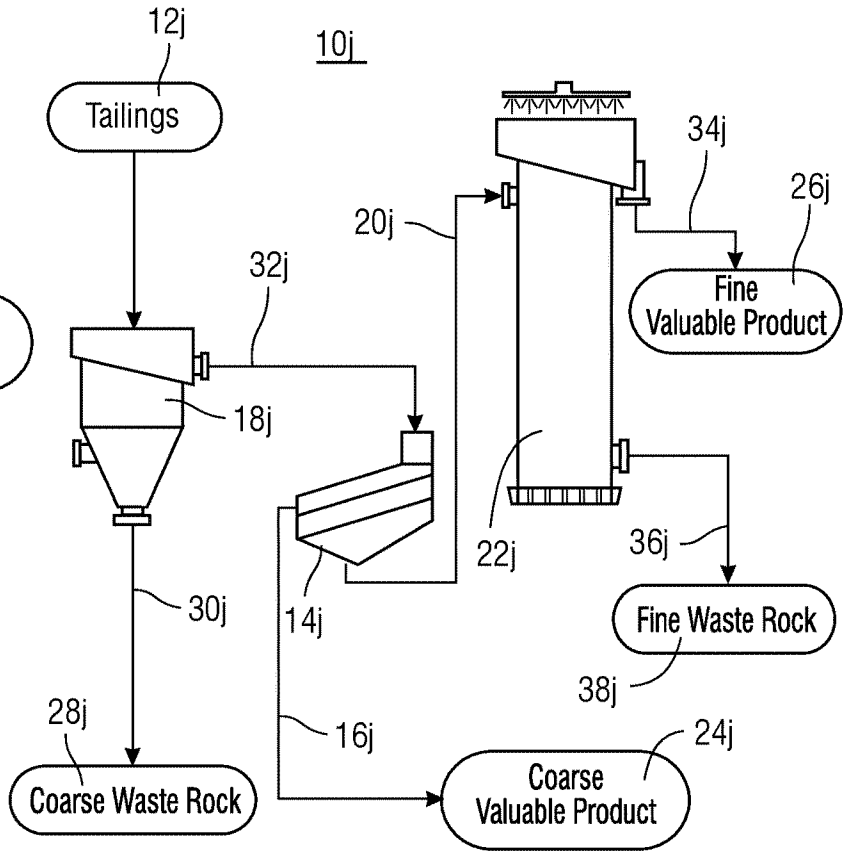
FIG. 2C shows a schematic view of another embodiment of the material processing system of FIG. 2.
Figure 2B:
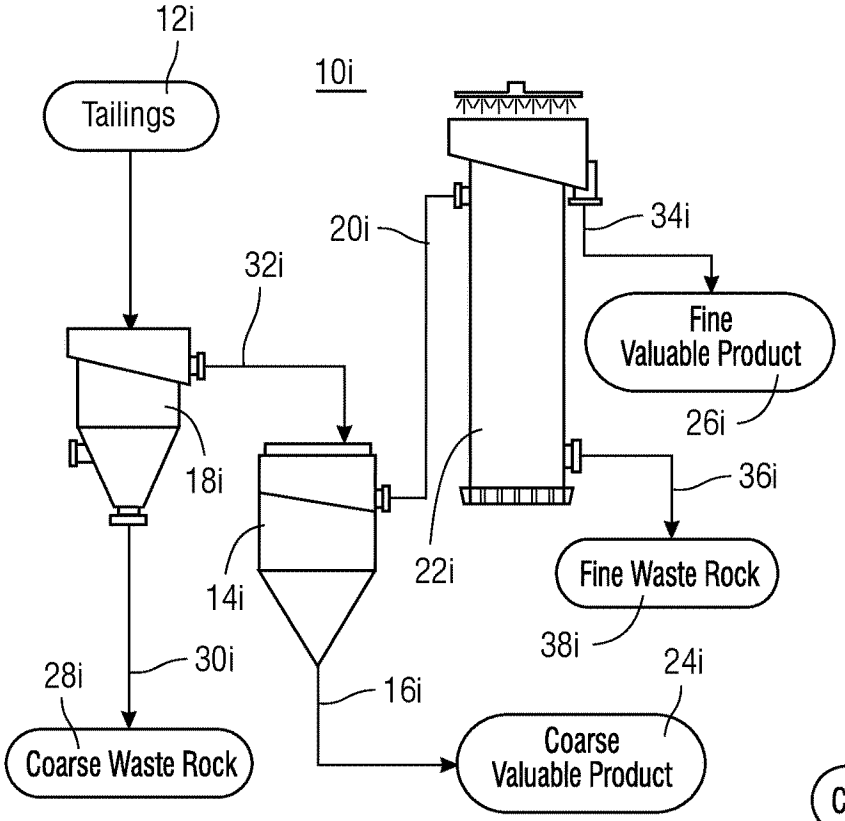
FIG. 2B shows a schematic view of another embodiment of the material processing system of FIG. 2.

FIG. 2B shows another embodiment of the material processing system 10*i* that implements the arrangements disclosed in FIG. 2 as discussed above. In this embodiment, the coarse flotation element 18*i* is an air-assisted hindered-bed density separator that functions in the same way as discussed above; the classification element 14*i* is a hindered-bed density separator that functions in the same way as discussed above; and the fines flotation element 22*i* is a column separator that also functions in the same way as discussed above.

FIG. 2C shows another embodiment of the material processing system 10*j* that implements the arrangements disclosed in FIG. 2 as discussed above. In this embodiment, the coarse flotation element 18*j* is an air-assisted hindered-bed density separator that functions in the same way as discussed above; the classification element 14*j* is a screen that functions in the same way as discussed above; and the fines flotation element 22*j* is a column separator that also functions in the same way as discussed above.

Figure 3A:
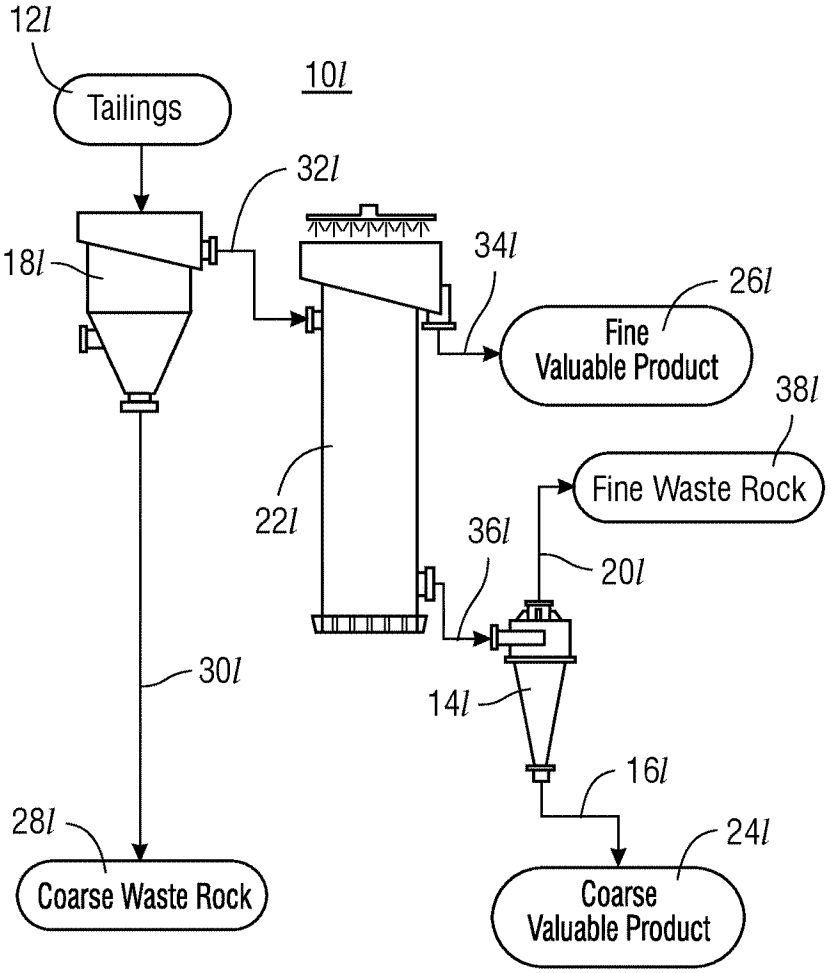
FIG. 3A shows a schematic view of an embodiment of the material processing system of FIG. 3.
Figure 3:
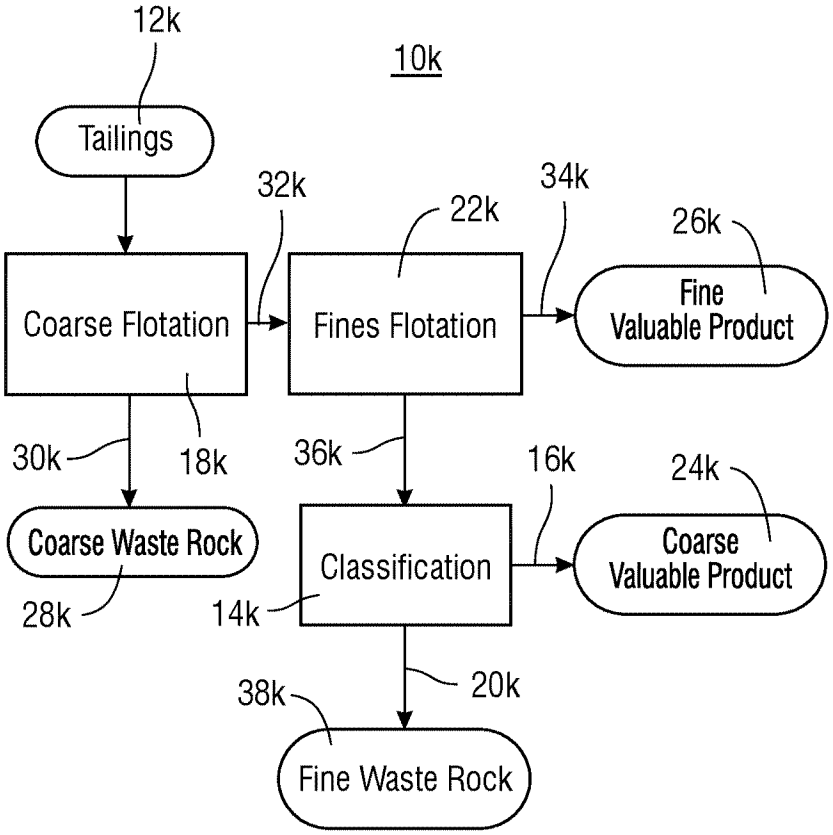
FIG. 3 shows a flow-chart of another configuration of the material processing system.

Another effective arrangement of the material processing system 10*k* is shown in FIG. 3. In this embodiment, the tailings 12*k* are first sent to the coarse flotation element 18*k* to separate and extract the coarse waste rock from the coarse valuable product, the fine waste rock, and the fine valuable product. The coarse flotation element 18*k* discharges the coarse valuable product, the fine valuable product, and the fine waste rock through the coarse/valuable product output 32*k* to the fines flotation element 22*k*. The fines flotation element 22*k* separates the fine valuable product from the fine waste rock and the coarse valuable product to the fine valuable product collection area 26*k* through the fine valuable product output 34*k*. The fine waste rock and the coarse valuable product pass through the fine waste output 36*k* to the classification element 14*k*. The classification element 14*k* then separates and extracts the coarse valuable product from the fine waste rock and conveys the coarse valuable product through the course output 16*k* to the coarse valuable product collection area 24*k* and the fine waste rock through the fines output 20*k* to the fine waste rock collection area 38*k*.

FIG. 3A shows an embodiment of the material processing system 10*l* that implements the arrangements disclosed in FIG. 3 as discussed above. In this embodiment, the coarse flotation element 18*l* is an air-assisted hindered-bed density separator that functions in the same way as discussed above; the classification element 14*l* is a cyclone separator that functions in the same way as discussed above; and the fines flotation element 22*l* is a column separator that also functions in the same way as discussed above.

Figure 3C:
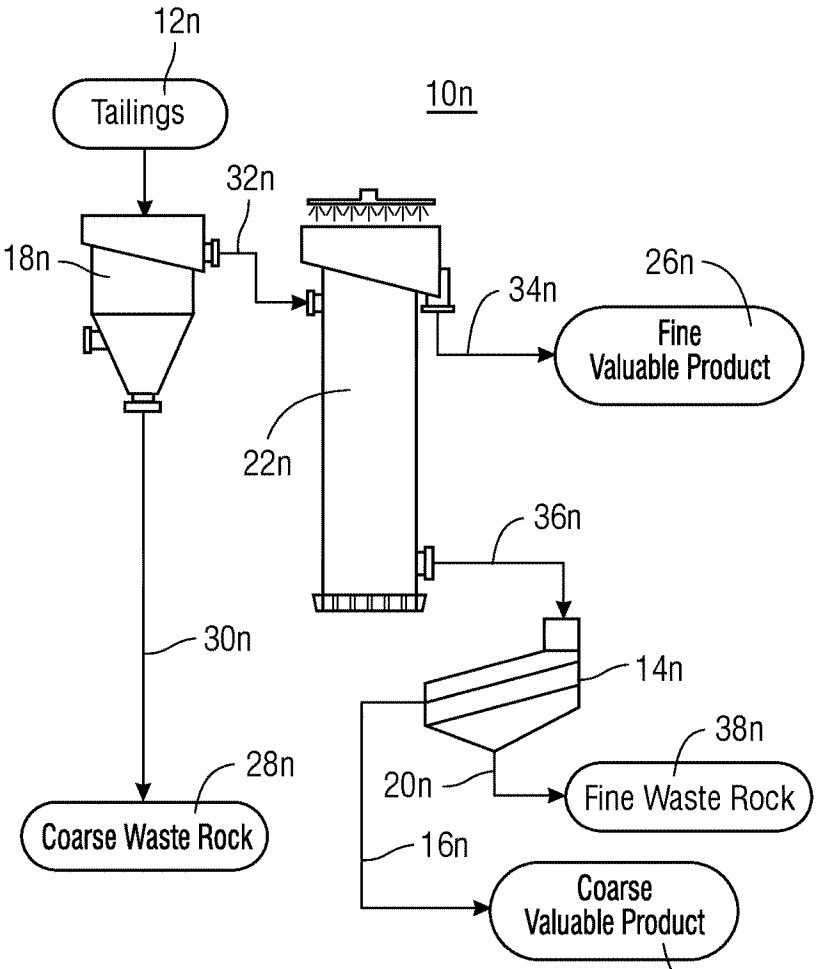
FIG. 3C shows a schematic view of another embodiment of the material processing system of FIG. 3.
Figure 3B:
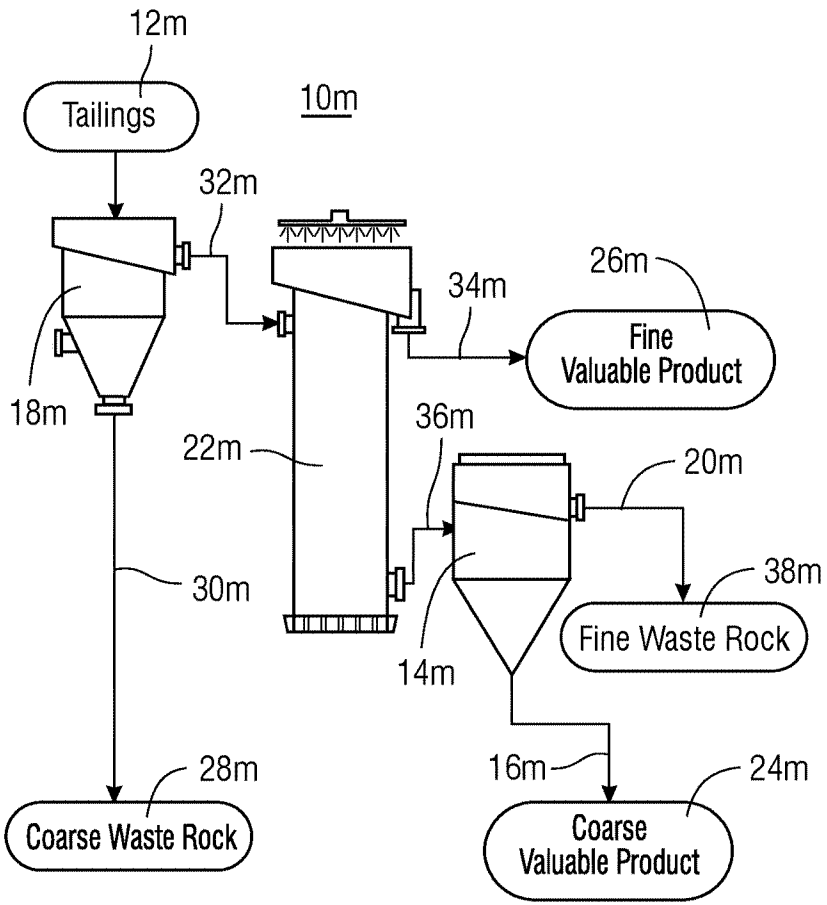
FIG. 3B shows a schematic view of another embodiment of the material processing system of FIG. 3.

FIG. 3B shows another embodiment of the material processing system 10*m* that implements the arrangements disclosed in FIG. 3 as discussed above. In this embodiment, the coarse flotation element 18*m* is an air-assisted hindered-bed density separator that functions in the same way as discussed above; the classification element 14*m* is a hindered-bed density separator that functions in the same way as discussed above; and the fines flotation element 22*m* is a column separator that also functions in the same way as discussed above.

FIG. 3C shows another embodiment of the material processing system 10*n* that implements the arrangements disclosed in FIG. 3 as discussed above. In this embodiment, the coarse flotation element 18*n* is an air-assisted hindered-bed density separator that functions in the same way as discussed above; the classification element 14*n* is a screen that functions in the same way as discussed above; and the fines flotation element 22*n* is a column separator that also functions in the same way as discussed above.

Figure 4A:
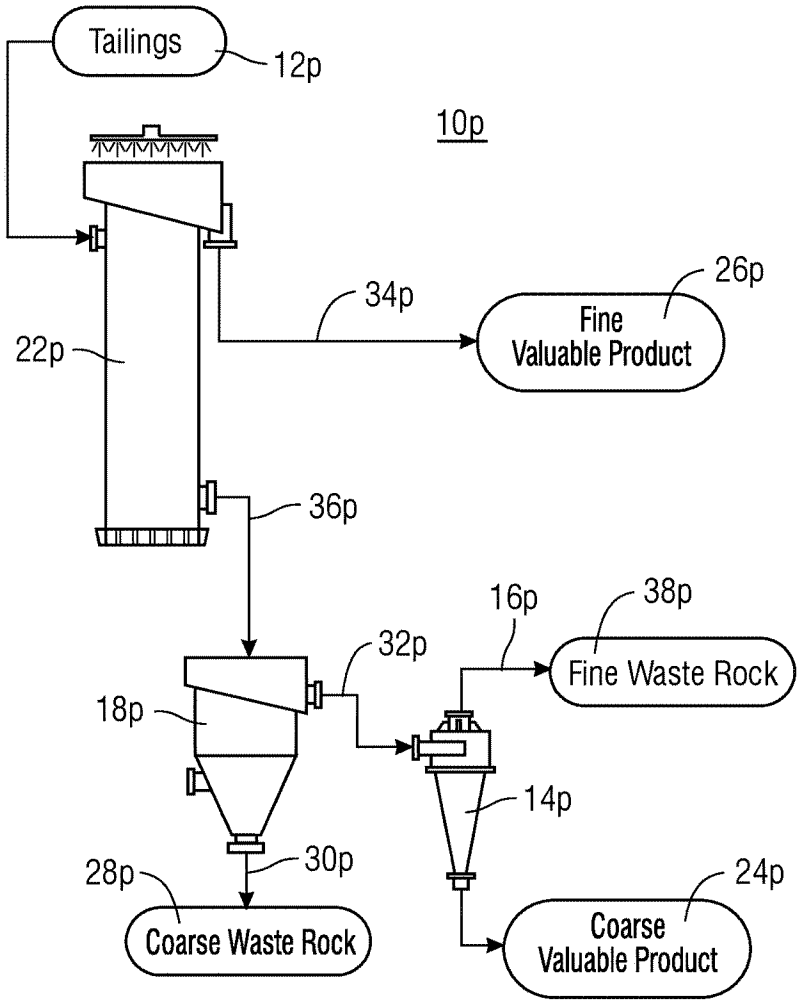
FIG. 4A shows a schematic view of an embodiment of the material processing system of FIG. 4.
Figure 4:
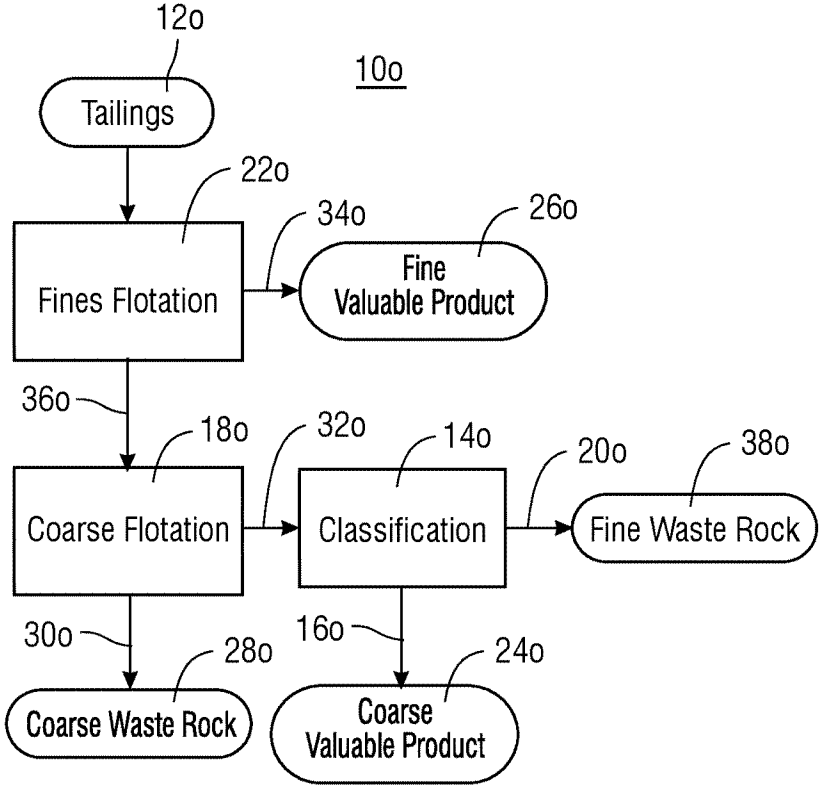
FIG. 4 shows a flow-chart of another configuration of the material processing system.

Another effective arrangement of the material processing system 10*o* is shown in FIG. 4. In this embodiment, the tailings 12*o* are first sent to the fines flotation element 22*o* to separate and extract the fine valuable product from the coarse valuable product, the fine waste rock, and the coarse waste rock. The fine valuable product is discharged through a fine valuable product output 34*o* to a fine valuable product collection area 26*o*. The fines flotation element 22*o* discharges the coarse valuable product, the fine waste rock, and the coarse waste rock through the fine waste output 36*o* to be conveyed to the coarse flotation element 180. The coarse flotation element 18*o* separates the coarse waste rock from the fine waste rock and the coarse valuable product. The coarse waste rock is discharged through a coarse waste output 30*o* to a coarse waste rock collection area 280. The coarse flotation element 18*o* discharges the fine waste rock and the coarse valuable product through the coarse/valuable product output 32*o* to the classification element 14*o*. The classification element 14*o* then separates and extracts the coarse valuable product from the fine waste rock. The coarse valuable product is discharged through the coarse output 16*o* to the coarse valuable product collection area 24*o* and the fine waste rock is discharged through the fines output 20*o* to the fine waste rock collection area 38*o*.

FIG. 4A shows an embodiment of the material processing system 10*p* that implements the arrangements disclosed in FIG. 4 as discussed above. In this embodiment, the coarse flotation element 18*p* is an air-assisted hindered-bed density separator that functions in the same way as discussed above; the classification element 14*p* is a cyclone separator that functions in the same way as discussed above; and the fines flotation element 22*p* is a column separator that also functions in the same way as discussed above.

Figure 4C:
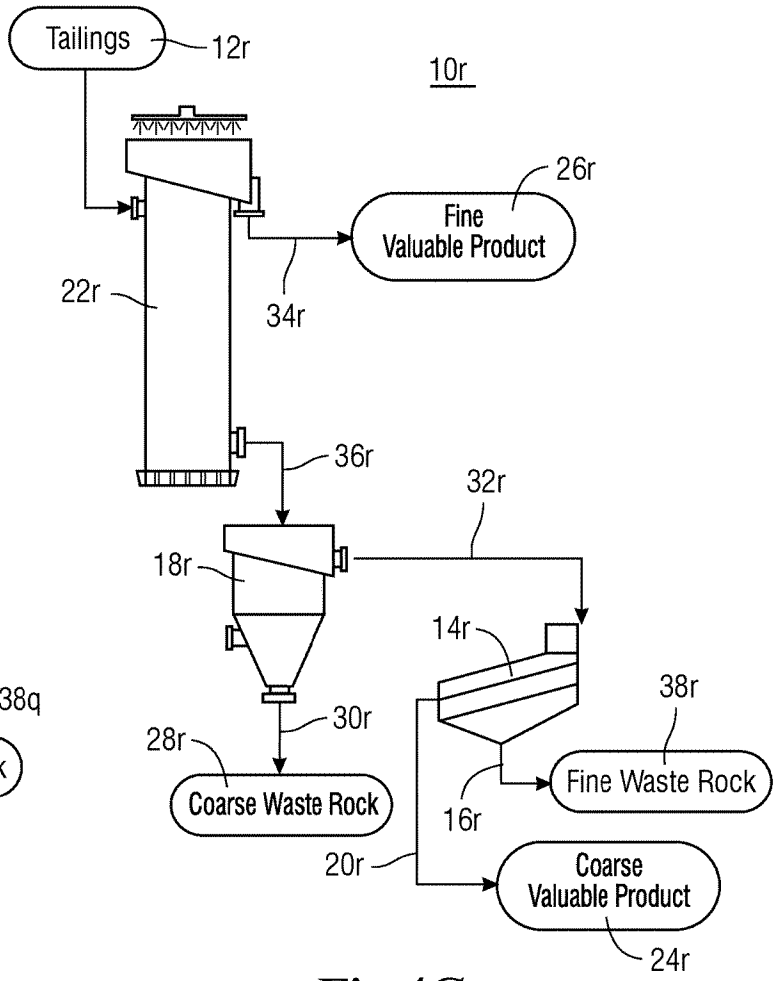
FIG. 4C shows a schematic view of another embodiment of the material processing system of FIG. 4.
Figure 4B:
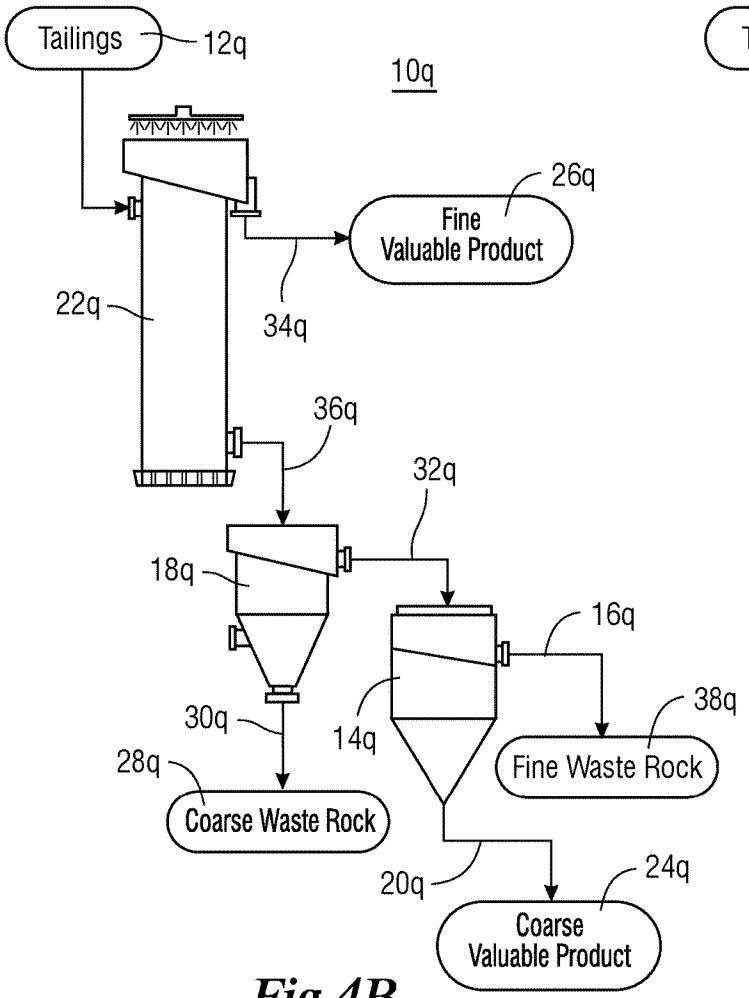
FIG. 4B shows a schematic view of another embodiment of the material processing system of FIG. 4.

FIG. 4B shows another embodiment of the material processing system 10*q* that implements the arrangements disclosed in FIG. 4 as discussed above. In this embodiment, the coarse flotation element 18*q* is an air-assisted hindered-bed density separator that functions in the same way as discussed above; the classification element 14*q* is a hindered-bed density separator that functions in the same way as discussed above; and the fines flotation element 22*q* is a column separator that also functions in the same way as discussed above.

FIG. 4C shows another embodiment of the material processing system 10*r* that implements the arrangements disclosed in FIG. 4 as discussed above. In this embodiment, the coarse flotation element 18*r* is an air-assisted hindered-bed density separator that functions in the same way as discussed above; the classification element 14*r* is a screen that functions in the same way as discussed above; and the fines flotation element 22*r* is a column separator that also functions in the same way as discussed above.

Figure 5A:
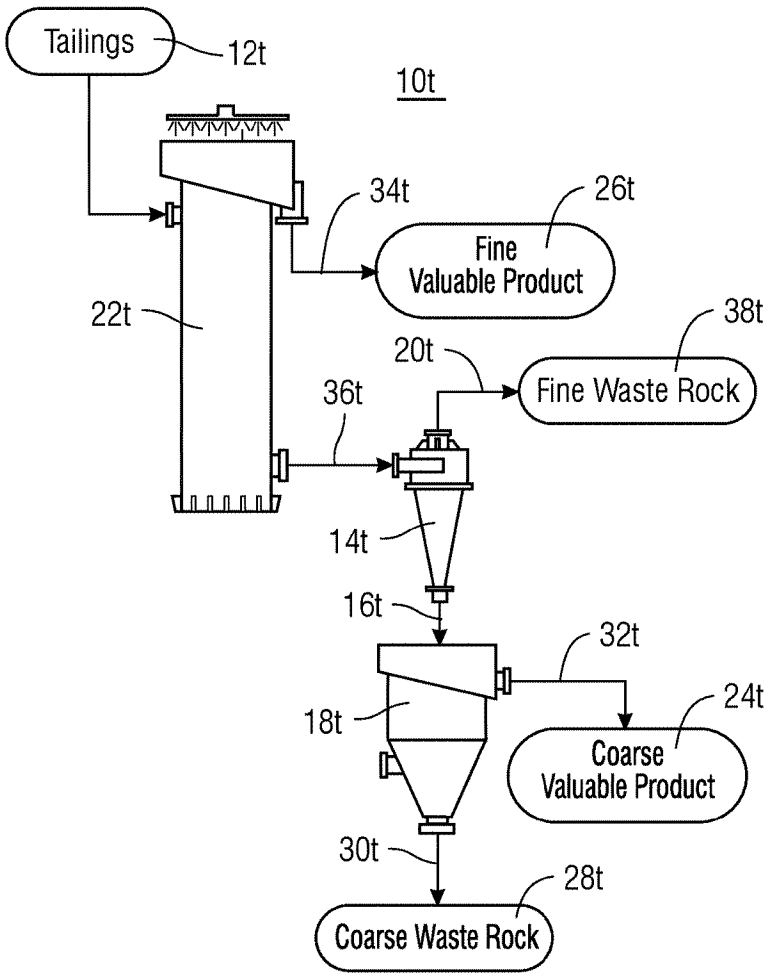
FIG. 5A shows a schematic view of an embodiment of the material processing system of FIG. 5.
Figure 5:
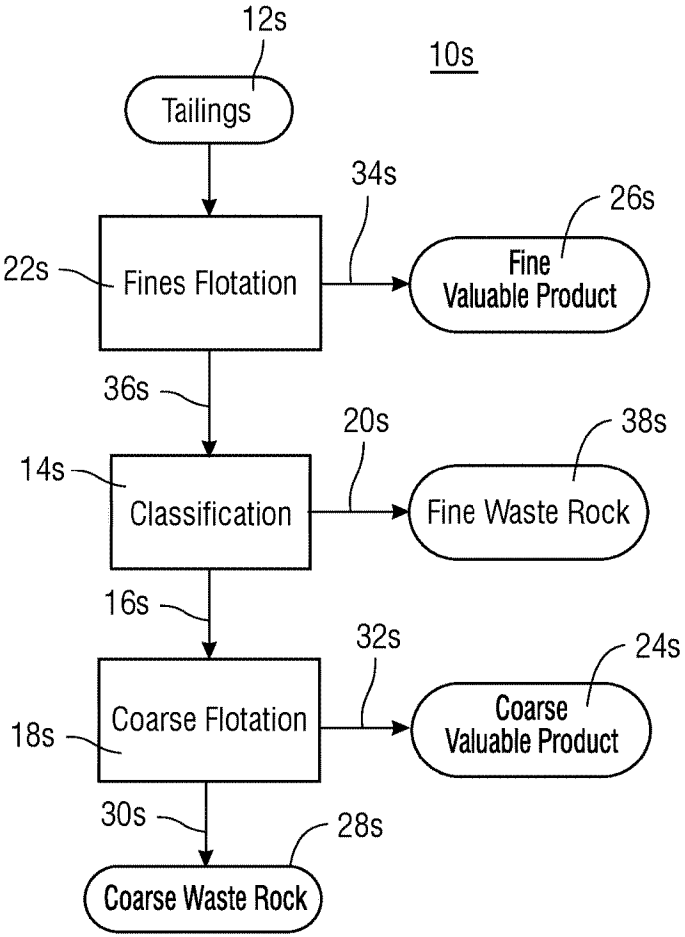
FIG. 5 shows a flow-chart of another configuration of the material processing system.

Another effective arrangement of the material processing system 10*s* is shown in FIG. 5. In this embodiment, the tailings 12*s* are first sent to the fines flotation element 22*s* to separate and extract the fine valuable product from the coarse valuable product, the fine waste rock, and the coarse waste rock. The fine valuable product is discharged through a fine valuable product output 34*s* to a fine valuable product collection area 26*s*. The fines flotation element 22*s* discharges the coarse valuable product, the fine waste rock, and the coarse waste rock through the fine waste output 36*s* to the classification element 14*s*. The classification element 14*s* separates the fine waste rock from the coarse waste rock and the coarse valuable product. The fine waste rock is discharged through the fines output 20*s* to the fine waste rock collection area 38*s*. The classification element 14*s* discharges the coarse waste rock and the coarse valuable product through the coarse output 16*s* to the coarse flotation element 18*s*. The coarse flotation element 18*s* then separates and extracts the coarse valuable product from the coarse waste rock. The coarse valuable product is discharged through the coarse/valuable product output 32*s* to the coarse valuable product collection area 24*s* and the coarse waste rock is discharged through the coarse waste output 30*a* to the coarse waste rock collection area 28*s*.

FIG. 5A shows an embodiment of the material processing system 10*t* that implements the arrangements disclosed in FIG. 5 as discussed above. In this embodiment, the coarse flotation element 18*t* is an air-assisted hindered-bed density separator that functions in the same way as discussed above; the classification element 14*t* is a cyclone separator that functions in the same way as discussed above; and the fines flotation element 22*t* is a column separator that also functions in the same way as discussed above.

Figure 5C:
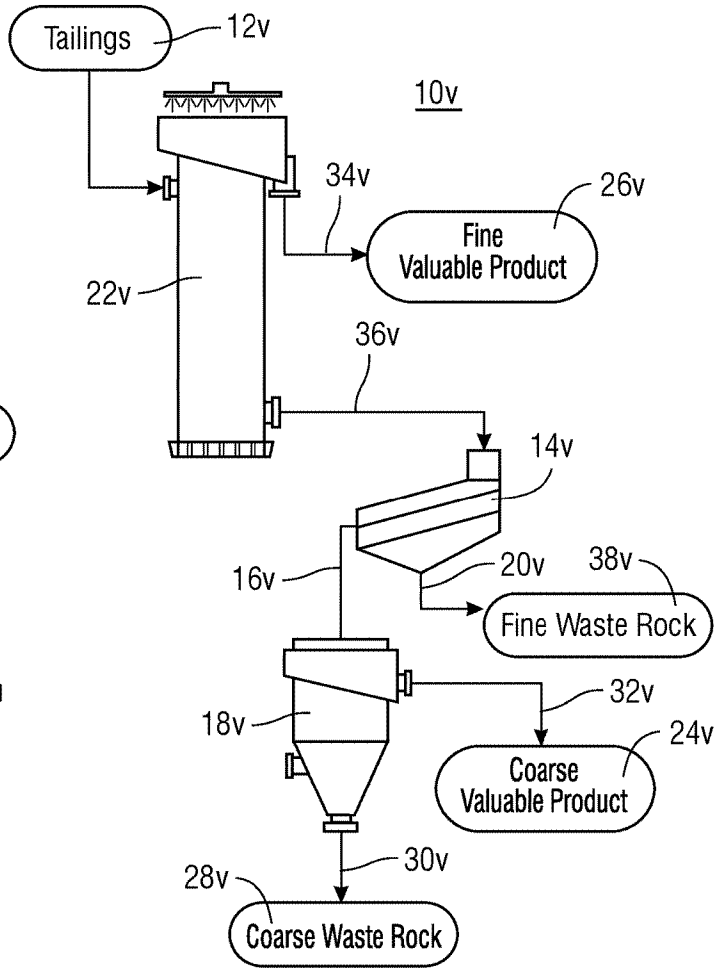
FIG. 5C shows a schematic view of another embodiment of the material processing system of FIG. 5.
Figure 5B:
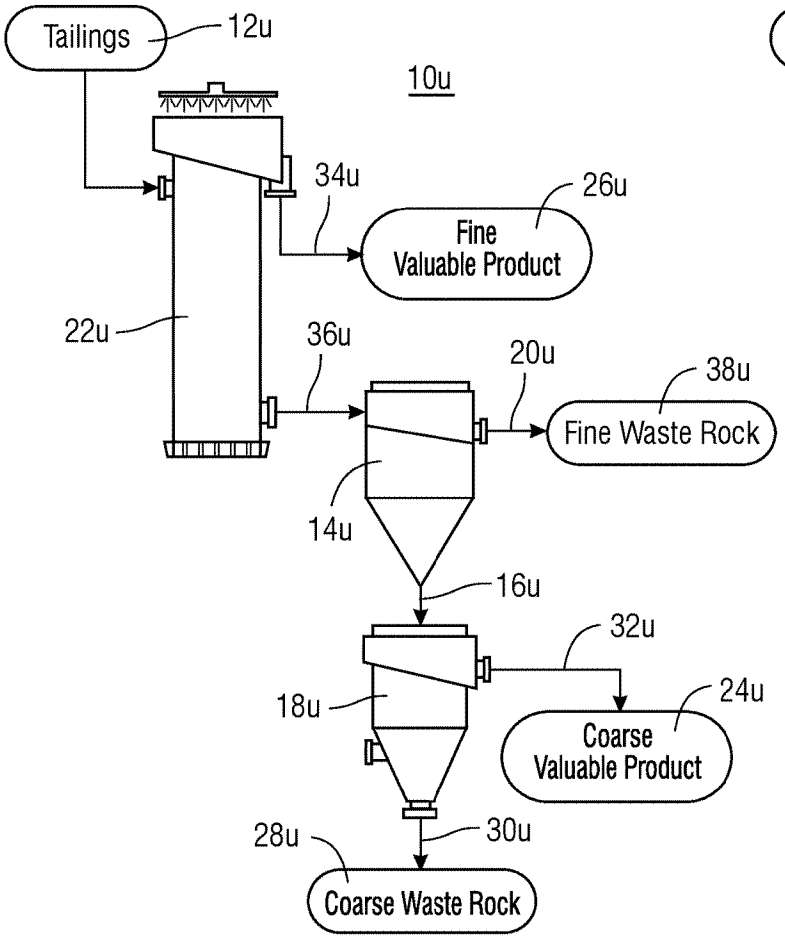
FIG. 5B shows a schematic view of another embodiment of the material processing system of FIG. 5.

FIG. 5B shows another embodiment of the material processing system 10*u* that implements the arrangements disclosed in FIG. 5 as discussed above. In this embodiment, the coarse flotation element 18*u* is an air-assisted hindered-bed density separator that functions in the same way as discussed above; the classification element 14*u* is a hindered-bed density separator that functions in the same way as discussed above; and the fines flotation element 22*u* is a column separator that also functions in the same way as discussed above.

FIG. 5C shows another embodiment of the material processing system 10*v* that implements the arrangements disclosed in FIG. 5 as discussed above. In this embodiment, the coarse flotation element 18*v* is an air-assisted hindered-bed density separator that functions in the same way as discussed above; the classification element 14*v* is a screen that functions in the same way as discussed above; and the fines flotation element 22*v* is a column separator that also functions in the same way as discussed above.

This invention has been described with reference to several preferred embodiments. Many modifications and alterations will occur to others upon reading and understanding the preceding specification. It is intended that the invention be construed as including all such alterations and modifications in so far as they come within the scope of the appended claims or the equivalents of these claims.

The invention claimed is:

1. A material processing system for processing tailings discharged from an ore processing system, the tailings comprising coarse waste rock, fine waste rock, coarse valuable product, and fine valuable product, said material processing system comprising:

a classification element, a second classification element, a coarse flotation element, and a fines flotation element arranged to separate the coarse valuable product, the coarse waste rock, the fine valuable product, and the fine waste rock;

said classification element separates the coarse waste rock and the coarse valuable product from the fine waste rock and the fine valuable product;

said second classification element for further classifying the coarse valuable product from the coarse waste rock, from the classification element;

said coarse flotation element separates the coarse waste rock from the coarse valuable product from said second classification element; and said fines flotation element separates the fine valuable product from the fine waste rock from the classification element or the second classification element or both.

2. A material processing system for processing tailings discharged from an ore processing system, the tailings comprising coarse waste rock, fine waste rock, coarse valuable product, and fine valuable product, said material processing system comprising;

a classification element, a second classification unit, a coarse flotation element, and a fines flotation element arranged to separate the coarse valuable product, the coarse waste rock, the fine valuable product, and the fine waste rock;

the tailings are sent to said classification element to separate the coarse waste rock and the coarse valuable product from the fine waste rock and the fine valuable product;

the coarse waste rock and the coarse valuable product from said classification element are sent to said coarse flotation element to separate the coarse valuable product from the coarse waste rock;

the coarse valuable product from said coarse flotation element is sent to said second classification element to further classify the coarse valuable product to remove any of the fine waste rock and the fine valuable product that may have bypassed said coarse flotation element in the coarse valuable product; and the fine waste rock and the fine valuable product from said classification element are sent to said fines flotation element to separate the fine valuable product from the fine waste rock.

3. A material processing system for processing tailings discharged from an ore processing system, the tailings comprising coarse waste rock, fine waste rock, coarse valuable product, and fine valuable product, said material processing system comprising;

a classification element, a second classification unit, a coarse flotation element, and a fines flotation element arranged to separate the coarse valuable product, the coarse waste rock, the fine valuable product, and the fine waste rock;

the tailings are sent to said classification element to separate the coarse waste rock and the coarse valuable product from the fine waste rock and the fine valuable product;

the coarse valuable product and the coarse waste rock from said classification element are sent to said second classification element to further classify the coarse valuable product and coarse waste rock to remove any of the fine waste rock and the fine valuable product that may have been wrongly separated by said classification element in the coarse valuable product and coarse waste rock;

the fine valuable product and the fine waste rock from said second classification element are reintroduced into the fine waste rock and the fine valuable product from said classification element; and the fine waste rock and the fine valuable product from said classification element are sent to said fines flotation element to separate the fine valuable product from the fine waste rock.

4. The material processing system of claim 1 wherein both the coarse valuable product and the fine valuable product are copper, gold, or phosphorous.

5. The material processing system of claim 1 wherein both the coarse valuable product and the fine valuable product are rendered hydrophobic.

6. The material processing system of claim 1 wherein said classification element sorts the tailings by mass.

7. The material processing system of claim 1 wherein said classification element is one of a cyclone separator, hindered-bed density separator, or screen.

8. The material processing system of claim 1 wherein said coarse flotation element an air-assisted hindered-bed density separator.

9. The material processing system of claim 1 wherein said fines flotation element is a column separator.

10. The material processing system of claim 1 further comprising a re-grind mill, a flotation machine, or any combination thereof, positioned to process coarse valuable product, the fine valuable product, or any combination thereof, from said classification element, coarse flotation element, and fines flotation element.

11. The material processing system of claim 1 wherein both the coarse valuable product and the fine valuable product are copper, gold, or phosphorous.

12. The material processing system of claim 1 wherein both the coarse valuable product and the fine valuable product are rendered hydrophobic.

13. The material processing system of claim 1 wherein said classification element sorts the tailings by mass.

14. The material processing system of claim 1 wherein said classification element is one of a cyclone separator, hindered-bed density separator, or screen.

15. The material processing system of claim 1 wherein said coarse flotation element an air-assisted hindered-bed density separator.

16. The material processing system of claim 1 wherein said fines flotation element is a column separator.

17. The material processing system of claim 1 further comprising a re-grind mill, a flotation machine, or any combination thereof, positioned to process coarse valuable product, the fine valuable product, or any combination thereof, from said classification element, coarse flotation element, and fines flotation element.

18. The material processing system of claim 3 wherein both the coarse valuable product and the fine valuable product are copper, gold, or phosphorous.

19. The material processing system of claim 3 wherein both the coarse valuable product and the fine valuable product are rendered hydrophobic.

20. The material processing system of claim 3 wherein said classification element sorts the tailings by mass.

21. The material processing system of claim 3 wherein said classification element is one of a cyclone separator, hindered-bed density separator, or screen.

22. The material processing system of claim 3 wherein said coarse flotation element an air-assisted hindered-bed density separator.

23. The material processing system of claim 3 wherein said fines flotation element is a column separator.

24. The material processing system of claim 3 further comprising a re-grind mill, a flotation machine, or any combination thereof, positioned to process coarse valuable product, the fine valuable product, or any combination thereof, from said classification element, coarse flotation element, and fines flotation element.

* * * * *